US011806998B2

(12) United States Patent
Ishikawa et al.

(10) Patent No.: US 11,806,998 B2
(45) Date of Patent: Nov. 7, 2023

(54) IMAGE FORMING APPARATUS AND IMAGE RECORDING METHOD

(71) Applicant: CANON KABUSHIKI KAISHA, Tokyo (JP)

(72) Inventors: Tomokazu Ishikawa, Kanagawa (JP); Fumitaka Goto, Tokyo (JP); Akitoshi Yamada, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/870,694

(22) Filed: Jul. 21, 2022

(65) Prior Publication Data

US 2023/0034010 A1 Feb. 2, 2023

(30) Foreign Application Priority Data

Jul. 29, 2021 (JP) ..... 2021-124185

(51) Int. Cl.
*B41J 2/045* (2006.01)
*B41J 2/21* (2006.01)

(52) U.S. Cl.
CPC ..... *B41J 2/04531* (2013.01); *B41J 2/04596* (2013.01); *B41J 2/2103* (2013.01)

(58) Field of Classification Search
CPC .. B41J 2/04531; B41J 2/04596; B41J 2/2103; B41J 2/36; B41J 2/335; B41J 2/3556; B41J 2/355; B41J 2/38
See application file for complete search history.

(56) References Cited

U.S. PATENT DOCUMENTS 6,186,683 B1 * 2/2001 Shibuki ..... B41J 2/355 347/195
8,164,609 B2 * 4/2012 Liu ..... B41J 2/355 347/175
2008/0187866 A1 8/2008 Cheon et al.
2008/0238967 A1 10/2008 Busch et al.
2008/0266373 A1 10/2008 Busch et al.
2020/0016905 A1 * 1/2020 Tsuchiya ..... B41J 2/3558

* cited by examiner

*Primary Examiner* — Kristal Feggins
(74) *Attorney, Agent, or Firm* — Canon U.S.A., Inc. I.P. Division

(57) ABSTRACT

An image forming apparatus includes a print head including heating elements for applying a thermal energy to an imaging material, an operation unit configured to operate the plurality of heating elements of the print head by using a first pulse for preheating the color developing layers and a second pulse for developing the colors of the color developing layers, and a generation unit configured to, in a case where a spatial frequency of the image to be recorded based on image data for forming an image on the imaging material is lower than a predetermined frequency, generate the first pulse so that a temperature to be applied to the imaging material by the first pulse is lower than a temperature to be applied to the imaging material in a case where the spatial frequency of the image data is equal to or higher than the predetermined frequency.

22 Claims, 15 Drawing Sheets

| | MAIN COLOR DEVELOPING LAYER | | |
|---|---|---|---|
| | IMAGE FORMING LAYER 14 | IMAGE FORMING LAYER 16 | IMAGE FORMING LAYER 18 |
| HIGH-FREQUENCY REGION | PREHEATING PULSE 2 | PREHEATING PULSE 2 | PREHEATING PULSE 1 |
| LOW-FREQUENCY REGION | PREHEATING PULSE 4 | PREHEATING PULSE 4 | PREHEATING PULSE 3 |

FIG.13

| | MAIN COLOR DEVELOPING LAYER | | |
|---|---|---|---|
| | IMAGE FORMING LAYER 14 | IMAGE FORMING LAYER 16 | IMAGE FORMING LAYER 18 |
| HIGH-FREQUENCY REGION | PREHEATING PULSE 2 | PREHEATING PULSE 2 | PREHEATING PULSE 1 |
| LOW-FREQUENCY REGION | PREHEATING PULSE 4 | PREHEATING PULSE 4 | PREHEATING PULSE 3 |

IMAGE FORMING APPARATUS AND IMAGE RECORDING METHOD

BACKGROUND

Field of the Disclosure

The present disclosure relates to an image forming apparatus and an image recording method.

Description of the Related Art

In conventional recording by a thermal print head, monochromatic printing using thermal paper and color printing using an ink ribbon have been widely used. In recent years, color recording using paper provided with a plurality of color developing layers has been proposed and widely used as a simple method for printing photographs. Each of the above-described plurality of color developing layers has a different heating temperature and a different heating duration for the color development. A color image is recorded by developing the color of a specific color developing layer utilizing these differences (refer to United States Patent Application Publication Nos. 2008/0187866 and 2008/0238967).

United States Patent Application Publication No. 2008/0266373 discusses a technique in which color developing layers are preheated before developing the colors of the color developing layers.

While the color developing layers are preheated in a conventional method, unnecessary preheating may be performed in some cases. In forming a low-frequency image on a recording medium, pixels subjected to the color development are often contiguous, and thus the heat applied to develop the color of one pixel is propagated to the subsequent pixel to preheat it. Additionally preheating pixels that have already been preheated in this way has little effect on the color development of the color developing layers, and may result in unnecessary power consumption.

SUMMARY

According to an aspect of the present disclosure, an image forming apparatus includes a print head including heating elements for applying a thermal energy to an imaging material having a plurality of color developing layers that are laminated from a side of the print head, the plurality of color developing layers corresponding to a plurality of colors and configured to develop colors when heated, and the print head configured to develop the color of a desired color developing layer from among the plurality of color developing layers to form an image on the imaging material, an operation unit configured to operate the plurality of heating elements of the print head by using a first pulse for preheating the color developing layers and a second pulse for developing the colors of the color developing layers, and a generation unit configured to, in a case where a spatial frequency of the image to be recorded based on image data for forming an image on the imaging material is lower than a predetermined frequency, generate the first pulse so that a temperature to be applied to the imaging material by the first pulse is lower than a temperature to be applied to the imaging material in a case where the spatial frequency of the image data is equal to or higher than the predetermined frequency.

Further features of the present disclosure will become apparent from the following description of exemplary embodiments with reference to the attached drawings.

BRIEF DESCRIPTION OF THE DRAWINGS

FIG. 13 is a table illustrating preheating pulses corresponding to each of spatial frequencies and main color developing layers of an image according to the second exemplary embodiment.

DESCRIPTION OF THE EMBODIMENTS

Imaging Material

Figure 1:
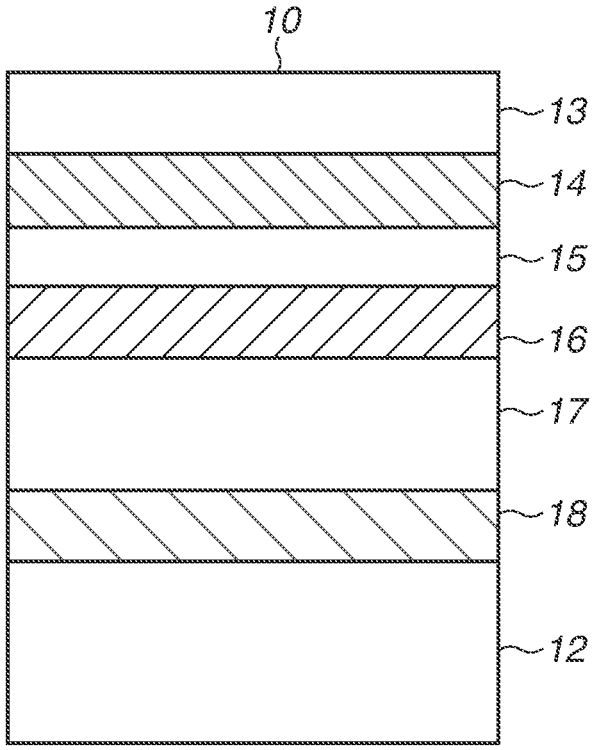
FIG. 1 illustrates an imaging material according to a first exemplary embodiment.

FIG. 1 is a conceptual view illustrating a configuration of an imaging material according to a first exemplary embodiment. The present exemplary embodiment will be described below centering on an infrared imaging method using infrared radiation as a heat source of an image forming apparatus. However, a method in which a thermal energy is applied by using other methods and heat sources is also applicable.

Referring to FIG. 1, an imaging material 10 subjected to image forming is formed of a substrate 12 that reflects light, an image forming layer 18, a spacer layer 17, an image forming layer 16, a spacer layer 15, an image forming layer 14, and a protective layer 13, sequentially from the bottom upward. The image forming layers 14, 16, and 18 are generally a yellow color developing layer, a magenta color developing layer, and a cyan color developing layer, respectively, in full color printing, but other color combinations are also applicable. Although the imaging material 10 in the example in FIG. 1 includes image forming layers (color developing layers) corresponding to three different colors, the imaging material 10 may be formed of more image forming layers or image forming layers corresponding to two different colors.

Each image forming layer is colorless in the initial state (i.e., before image forming) and changes to a corresponding color when heated to a specific temperature called the activation temperature for each image forming layer. According to the present exemplary embodiment, the coloring property for the color development is assumed to be different for each image forming layer.

The order of the image forming layer colors (order of stacked layers) in the imaging material 10 can be arbitrarily selected. A preferred order of colors is as described above. In another preferred order, the three different image forming layers 14, 16, and 18 are a cyan color developing layer, a magenta color developing layer, and a yellow color developing layer, respectively. The present exemplary embodiment will be described below centering on an example where the imaging material 10 is formed of the yellow, the magenta, and the cyan layers in this order. Referring to FIG. 1, although the image forming layers having a similar thickness are stacked, the present disclosure is not limited thereto. The image forming layers may have different thicknesses according to the color (coloring material).

As illustrated in FIG. 1, spacer layers are provided between the image forming layers. The thickness of each spacer layer may be defined according to the coloring property of each image forming layer, and the thermal conduction characteristics and thermal diffusivity of each spacer layer. For example, the spacer layers may be made of the same material or different materials. The function of the spacer layers is to control the thermal diffusion in the imaging material 10. Preferably, in a case where the spacer layers 17 and 15 are made of the same material, the spacer layer 17 is at least four times thicker than the spacer layer 15.

All layers disposed in the substrate 12 are substantially transparent before the image forming. If the substrate 12 has a reflection color (e.g., white color), a color image formed by the imaging material 10 is visually recognized via the protective layer 13 against the reflection background provided by the substrate 12. Since the layers stacked on the substrate 12 are transparent, a combination of the colors printed on these image forming layers can be visually perceived by the human eyes.

Although, in the present exemplary embodiment, the three image forming layers 14, 16, and 18 in the imaging material 10 are arranged on the same side of the substrate 12, some of the image forming layers may be disposed on the side opposite to the substrate 12.

According to the present exemplary embodiment, the image forming layers 14, 16, and 18 are processed at least partially and independently by the change of two controllable parameters, i.e., the temperature and the duration of time. By controlling these parameters, i.e., the temperature of the print head and the duration when heat is applied to the imaging material 10, an image is formed in desired image forming layers. More specifically, controlling the temperature to be applied to the imaging material 10 and the application time duration enables developing desired colors of desired image forming layers.

According to the present exemplary embodiment, each of the image forming layers 14, 16, and 18 is processed when the print head applies heat while in contact with the top layer of the imaging material 10, i.e., the protective layer 13 illustrated in FIG. 1. The coloring property of each image forming layer according to the present exemplary embodiment will be described below. The image forming layers 14, 16, and 18 have activation temperatures Ta3, Ta2, and Ta1, respectively.

In this case, the activation temperature Ta3 of the image forming layer 14 is higher than the activation temperature Ta2 of the image forming layer 16, and is higher than the activation temperature Ta1 of the image forming layer 18.

The relation between activations (coloring properties) of the image forming layers will be described below with reference to FIG. 2.

The heat applied to the image forming layers at positions farther from the print head (protective layer 13) is conducted and diffused to these layers via the spacer layers, and therefore is delayed by the time required for heating. Therefore, even when the temperature applied to the surface of the imaging material 10 (protective layer 13) by the print head is substantially higher than the activation temperature of an image forming layer at a lower position (a layer farther from the print head), the heating is delayed due to the thermal diffusion in each layer. This makes it possible to perform control to heat the image forming layer closer to the print head up to the activation temperature while preventing the activation of the lower image forming layers. Therefore, when processing (when developing the color of) only the image forming layer 14 closest to the protective layer 13, the print head heats the layer to a relatively high temperature (Ta3 or higher) in a short time. In this case, the image forming layers 16 and 18 are not sufficiently heated, and therefore are not subjected to the color development (activation).

When activating only an image forming layer close to the substrate 12 (the image forming layer 16 or 18 in this case), the activation is accomplished by heating the layer at a temperature lower than the activation temperature of an image forming layer farther from the substrate 12 (e.g., the image forming layer 14) for a sufficiently prolonged period of time. In this way, when a lower image forming layer (the image forming layers 16 or 18) is activated, while the higher image forming layer (e.g., the image forming layer 14) is not activated.

As described above, it is preferable to heat the imaging material 10 by using a thermal print head. However, other methods are also applicable. For example, any one of known methods such as a modulated light source (such as a laser method) is applicable.

Coloring Property

Figure 2:
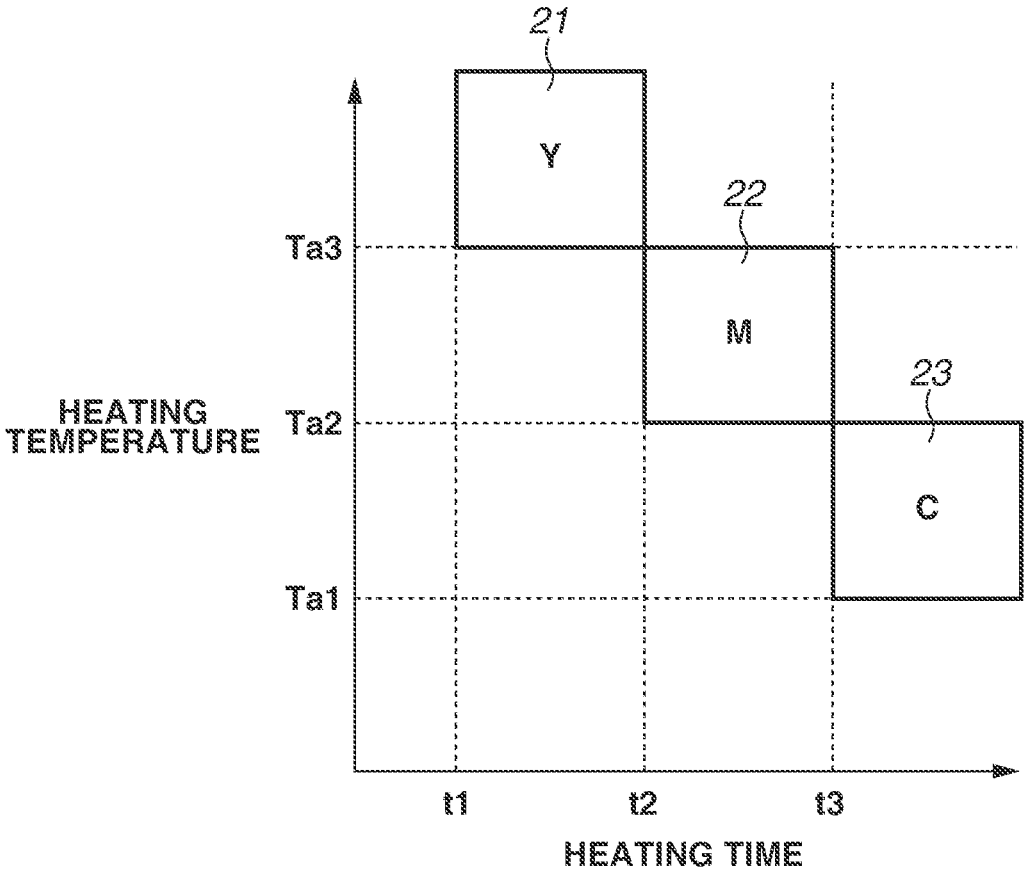
FIG. 2 illustrates a coloring property of the imaging material according to the first exemplary embodiment.

FIG. 2 illustrates a relation between the heating temperature and the heating time for processing the image forming layers 14, 16, and 18 forming the imaging material 10. Referring to FIG. 2, the vertical axis indicates the heating temperature on the surface of the imaging material 10 in contact with the print head, and the horizontal axis indicates the heating time. The relation will be described below on the premise that the heating temperature is identical to the temperature supplied by the print head.

A region 21 indicates a relatively high heating temperature and a relatively short heating time. According to the present exemplary embodiment, the region 21 corresponds to yellow of the image forming layer 14. More specifically, when the image forming layer 14 is supplied with an energy illustrated in the region 21, the color development (image forming) is performed. A region 22 indicates an intermediate heating temperature and an intermediate heating time. The region 22 corresponds to magenta of the image forming layer 16. More specifically, when the image forming layer 16 is supplied with an energy illustrated in the region 22, the color development (image forming) is performed. The region 23 indicates a relatively low heating temperature and a relatively long heating time. The region 22 corresponds to cyan of the image forming layer 18. More specifically, when the image forming layer 18 is supplied with an energy illustrated in the region 23, the color development (image forming) is performed. The time required for imaging (color development) of the image forming layer 18 is substantially longer than the time required to visualize the image forming layer 14.

The activation temperature selected for the image forming layers is, for example, within a range from about 90° C. to about 300° C. It is preferable that, during shipment and storage, the activation temperature (Ta1) of the image forming layer 18 is consistently as low as possible in terms of the thermostability of the imaging material 10. Preferably, the activation temperature (Ta1) is about 100° C. or higher. It is preferable that the activation temperature (Ta3) of the image forming layer 14 is consistently high for the activation of the image forming layers 16 and 18 by heating via the layer 14. Preferably, the activation temperature (Ta3) is about 200° C. or higher. The activation temperature (Ta2) of the image forming layer 16 is between Ta1 and Ta3. Preferably, the activation temperature (Ta2) is between about 140° C. and about 180° C.

Even when each image forming layer is applied with the energy in the corresponding region, the density of the formed color depends on the position in the region. For example, in a case where the image forming layer 16 is applied with the energy in the region 22, applying a temperature close to Ta3 forms an image with a higher density than applying a temperature close to Ta2 for the same heating time. This also applies to a case of varying the heating time.

Print Head

The print head according to the present exemplary embodiment includes a substantially liner array of resistors extending over the entire width of an image. According to the present exemplary embodiment, the print head extends in a direction perpendicular to the conveyance direction of the imaging material 10 (width direction of the imaging material 10), and resistors are disposed along the width direction.

When the resistors of the print head are supplied with a current, the resistors operate as heating elements and function as a heat source. When the imaging material 10 is conveyed while receiving heat from the resistors of the print head, imaging is performed in each image forming layer. As described above, according to the present exemplary embodiment, the resistors are configured to emit infrared radiation. Typically, the time during which heat is applied to the imaging material 10 by the print head is within about 0.001 to about 100 milliseconds for each line of the image. The upper limit is set in relation to the printing time, and the lower limit is defined based on the limitation on an electronic circuit (not illustrated). The distance between image forming dots is generally within a range from 100 to 600 lines per inch in both the conveyance and the width directions of the imaging material 10, and may be different for each direction.

Figure 3A:
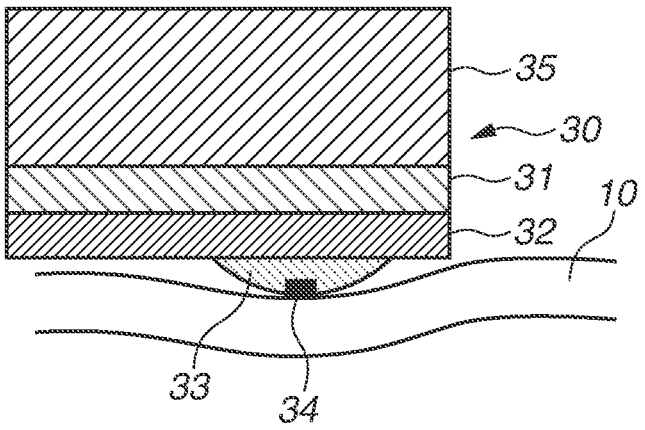
FIGS. 3A and 3B illustrate a configuration of a print head according to the first exemplary embodiment.
Figure 3B:
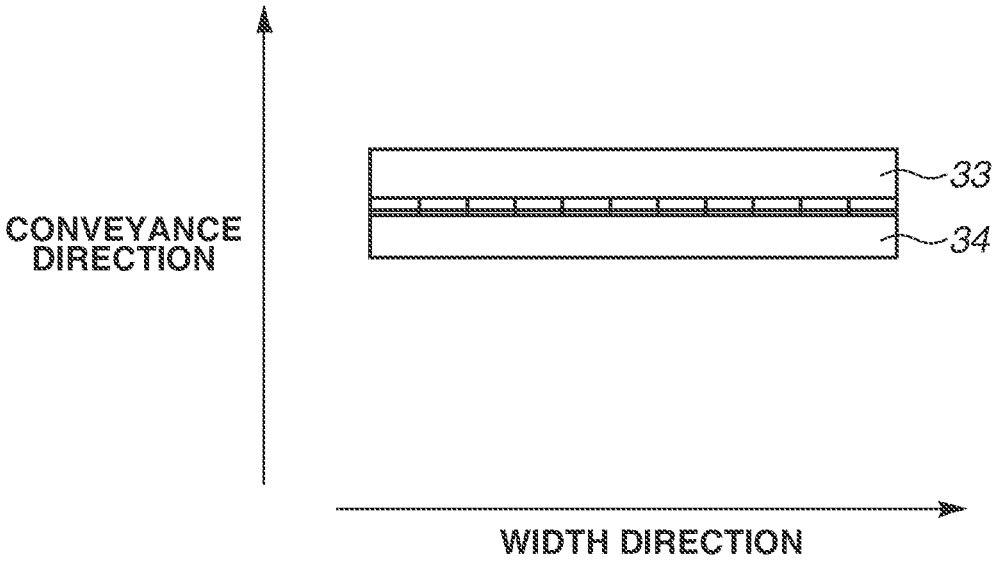

FIGS. 3A and 3B illustrate an example of a configuration of the print head during image forming, and an example of a configuration of the imaging material 10, respectively, according to the present exemplary embodiment. Referring to FIG. 3A, the imaging material 10 is conveyed to the right during image forming. The width direction of the imaging material 10 corresponds to the depth direction in FIG. 3A. A print head 30 is provided with a glaze 32 on a base 31. According to the present exemplary embodiment, the glaze 32 is further provided with a convex glaze 33. A resistor 34 is disposed on the surface of the convex glaze 33 so as to come into contact with the imaging material 10 that is conveyed in the conveyance direction. The convex glaze 33 may have other shapes and may not be provided. In this case, the resistor 34 is configured to come into contact with the imaging material 10. It is preferable that a protective layer (not illustrated) is formed on the resistor 34, the glaze 32, and the convex glaze 33. Generally, a combination of the glaze 32 and the convex glaze 33 made of the same material will be hereinafter collectively referred to as a "glaze of print head".

The base 31 and a heat sink 35 are provided on the glaze 32. The base 31 is in contact with the heat sink 35 and is cooled by a cooling unit such as a fan (not illustrated). The imaging material 10 generally comes into contact with the glaze of the print head 30 which is longer than the length of the actual heating resistor in the conveyance direction. The length of the resistor is typically around 120 microns in the conveyance direction of the imaging material 10. The length of the thermal contact region on the imaging material 10 in thermal contact with the glaze of the print head is generally 200 microns or more.

FIG. 3B illustrates an example of an array of the resistor 34 in the width direction. A plurality of the resistors 34 is arranged in the width direction to occupy a fixed length in the width direction of the imaging material 10. An image for one line is formed along this array. In the following example, an image is formed for each line while the imaging material 10 is being conveyed in the conveyance direction.

Image Forming Apparatus

Figure 4:
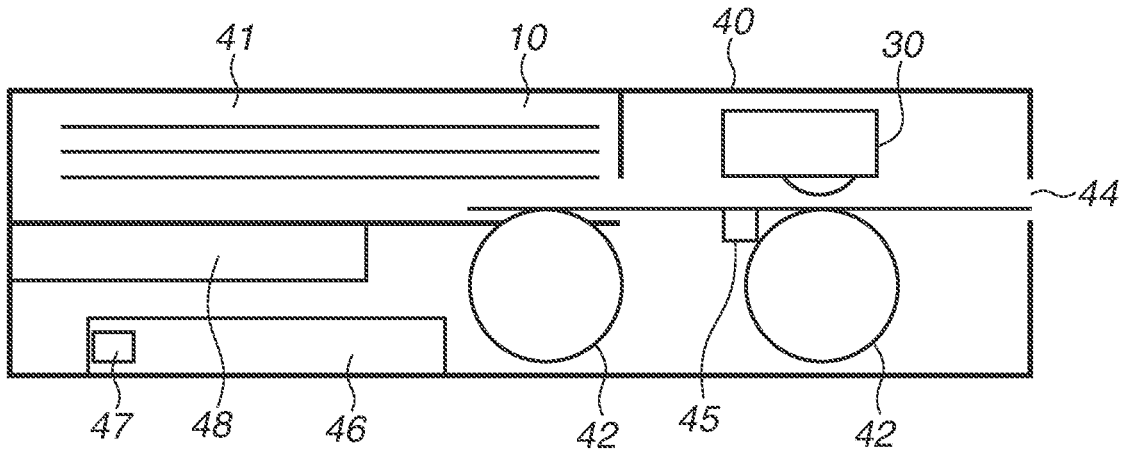
FIG. 4 schematically illustrates a cross-sectional configuration of an image forming apparatus according to the first exemplary embodiment.

FIG. 4 is a cross-sectional view illustrating an example of a configuration of the image forming apparatus according to the present exemplary embodiment. An image forming apparatus 40 includes the print head 30 (on the downstream side of the imaging material 10), a storage unit 41, conveyance rollers 42, a platen 43, a discharge port 44, a temperature sensor 45, a camera 46, an imaging button 47, and a battery 48. The storage unit 41 stores a plurality of the imaging materials 10. The imaging materials 10 can be replenished by opening and closing a cover (not illustrated). At the time of printing, the imaging material 10 is fed to the print head 30 by the conveyance rollers 42, subjected to the image forming between the platen 43 and the print head 30, and then discharged from the discharge port 44 (printing completed). The temperature sensor 45 is disposed in the periphery of the nip portion between the print head 30 and the platen 43 to detect the temperature supplied by the print head 30. Examples of targets to be detected by the temperature sensor 45 include the temperature of the resistor 34 (heat source) of the print head 30 and the surface temperature of the imaging material 10. Further, the temperature sensor 45 may be configured to detect the ambient temperature of the image forming apparatus 40.

The conveyance speed of the imaging material 10 is controlled according to the image forming speed and the image forming resolution. For example, the conveyance speed in high-resolution image forming may be lower than that in low-resolution image forming. When giving priority to the printing speed, image forming may be performed with the increased conveyance speed and decreased resolution.

System Configuration

Figure 5:
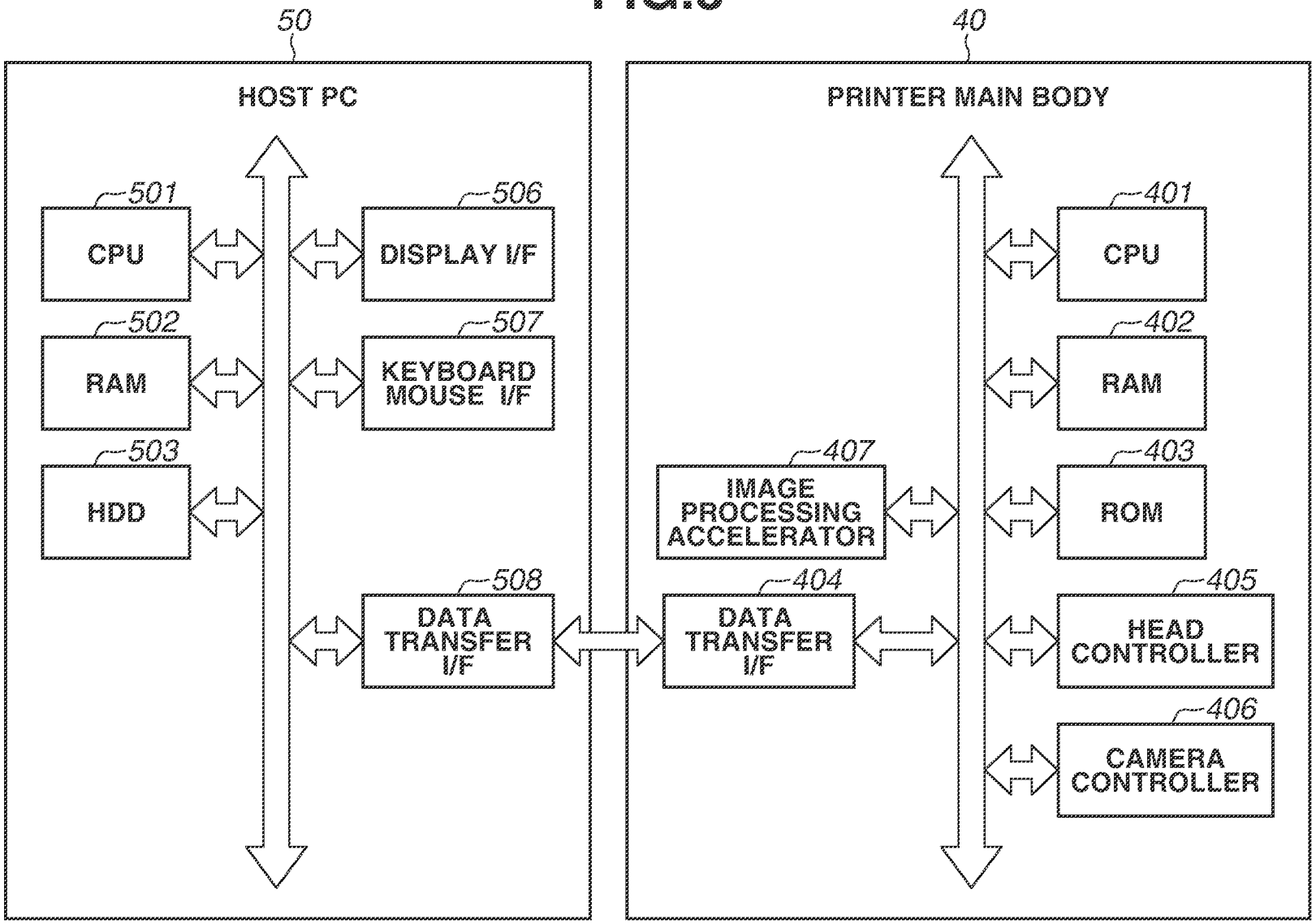
FIG. 5 illustrates an example of a system configuration according to the first exemplary embodiment.

FIG. 5 illustrates an example of an overall configuration of a system according to the present exemplary embodiment.

As illustrated in FIG. 5, the system according to the present exemplary embodiment includes the image forming apparatus 40 illustrated in FIG. 4, and a personal computer (PC) 50 as a host apparatus for the image forming apparatus 40.

The PC 50 includes a central processing unit (CPU) 501, a random access memory (RAM) 502, a hard disk drive (HDD) 503, a communication interface (I/F) 504, an input device I/F 505, and a display device I/F. Each unit is communicably connected with each other via an internal bus. The CPU 501 performs processing according to programs and various pieces of data stored in the HDD 503 and the RAM 502. The RAM 502, which is a volatile storage, temporarily stores programs and data. The HDD 503, which is a nonvolatile storage, also stores programs and data.

The communication I/F 504 is an interface that controls communication with an external apparatus. In this case, the communication I/F 504 controls data transmission and reception with the image forming apparatus 40. Examples of connection methods for data transmission and reception include wired connections such as a universal serial bus (USB), Institute of Electrical and Electronics Engineers (IEEE) 1394, and local area network (LAN) and wireless connections such as Bluetooth® and Wi-Fi®. The input device I/F 505 is an interface that controls a human interface device (HID) such as a keyboard and a mouse, and accepts an input from an input device by the user. The display device I/F 506 controls the display on a display device (not illustrated) such as a display.

The image forming apparatus 40 includes a CPU 401, a RAM 402, a ROM 403, a communication I/F 404, a head controller 405, a camera controller 406, and an image processing accelerator 407. Further, these units are communicably connected with each other via an internal bus. The CPU 401 performs the processing of each exemplary embodiment (described below) according to programs and various data stored in the ROM 403 and the RAM 402. The RAM 402, which is a volatile storage, temporarily stores programs and data. The ROM 403, which is a nonvolatile storage stores table data and programs used in the processing to be described below.

The communication I/F 404 is an interface that controls communication with an external apparatus. In this case, the communication I/F 404 controls data transmission and reception with the PC 50. The head controller 405 controls a heating operation of the print head 30 illustrated in FIG. 3A based on recording data. More specifically, the head controller 405 is configured to read control parameters and head recording data from a predetermined address in the RAM 402. When the CPU 401 writes control parameters and recording data to a predetermined address in the RAM 402, the head controller 405 starts processing to perform a heating operation of the print head 30. The camera controller 406 controls the camera 46 illustrated in FIG. 4. More specifically, when the user presses the imaging button 47, the camera controller 406 issues an imaging instruction to the camera 46, and the camera 46 captures an image. The captured image is temporarily stored in the RAM 402. Then, when printing the captured image, the head controller 405 starts processing to perform a heating operation on the print head 30. The image processing accelerator 407 configured by hardware performs image processing at higher processing speed than the CPU 401. More specifically, the image processing accelerator 407 is configured to read parameters and data required for the image processing from a predetermined address in the RAM 402. When the CPU 401 writes the above-described parameters and data at a predetermined address in the RAM 402, the image processing accelerator 407 is activated to perform predetermined image processing. The image processing accelerator 407 is not necessarily an essential element. Depending on the printer specifications, the CPU 401 alone may perform the above-described table parameter generation processing and image processing. The temperature sensor 45 detects the ambient temperature of the resistor 34 of the print head 30 as illustrated in FIG. 4, and provides the temperature information to the CPU 401. The CPU 401 generates control parameters for performing heating control on the resistor 34 of the print head 30 based on the acquired temperature information. Detailed control will be described below.

Although, in the present exemplary embodiment, the image forming apparatus 40 and the PC 50 have been described as different apparatuses, the system may integrate these apparatuses as one apparatus or integrate the image forming apparatus 40 and an imaging apparatus (not illustrated) as one apparatus. While a PC has been described above as an example of a host apparatus, the present disclosure is not limited thereto. The host apparatus may be a mobile terminal such as a smart phone, tablet terminal, and an imaging apparatus.

Printing Service

Figure 6:
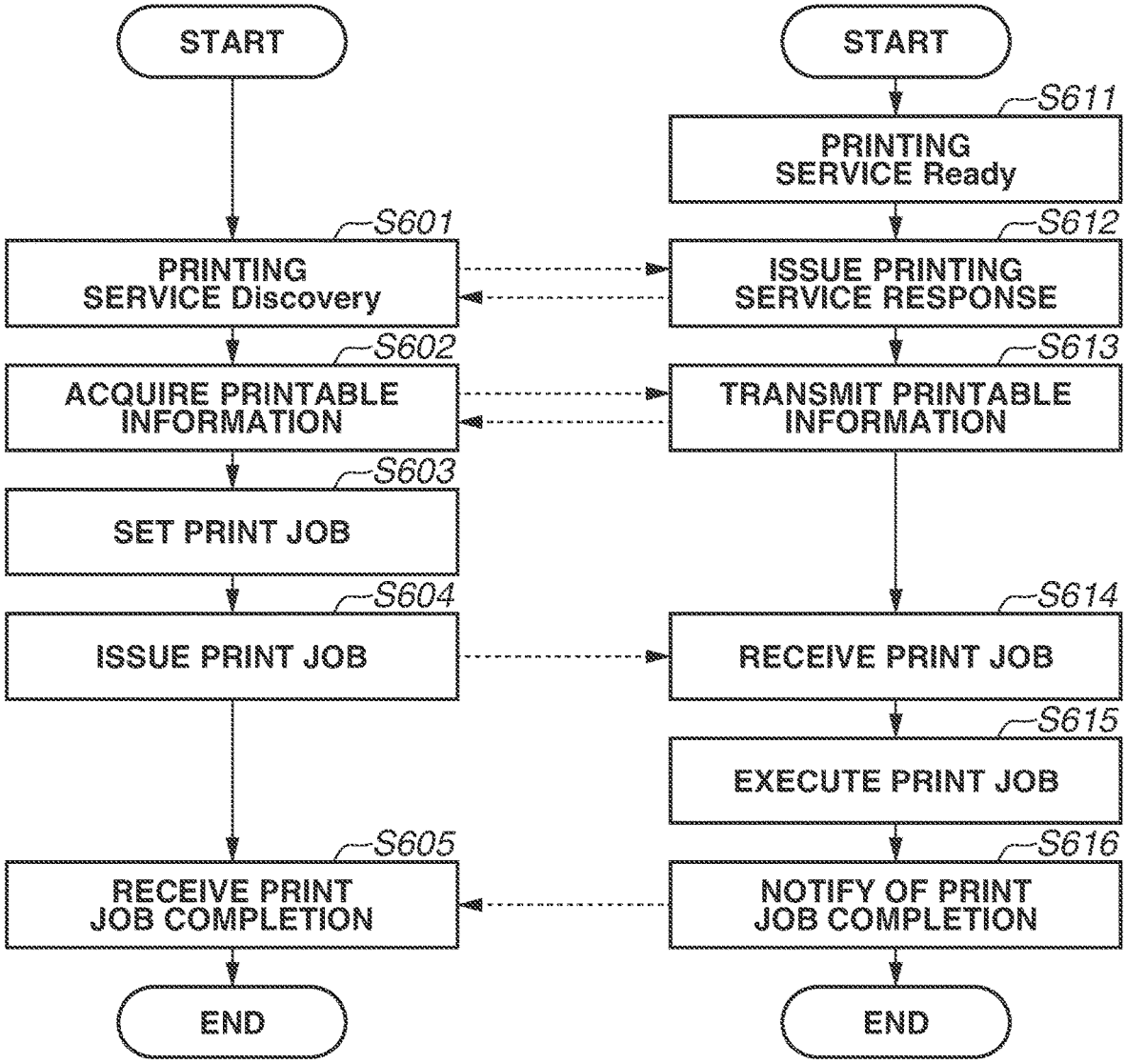
FIG. 6 is a sequence diagram of a printing service according to the first exemplary embodiment.

FIG. 6 illustrates a sequence of a printing service performed by the system according to the present exemplary embodiment. Referring to FIG. 6, steps S601 to 605 indicate processing performed by the PC 50, and steps S611 to S616 indicate processing performed by the image forming apparatus 40. Referring to FIG. 6, broken line arrows indicate data transmission and reception. Each step is implemented when the CPU of each apparatus reads a program stored in the storage unit and then executes the program. When the user performs printing, this sequence is started.

When power is turned ON, then in step S611, the image forming apparatus 40 confirms that the apparatus 40 itself is ready for printing, i.e., ready for providing a printing service and enters a standby state.

Meanwhile, in step S601, the PC 50 implements a printing service Discovery. In the printing service Discovery may be configured to search for a peripheral device according to a user operation or periodically search for an image forming apparatus which is ready to provide a printing service. Alternatively, the PC 50 may be configured to make an inquiry when the PC 50 and the image forming apparatus 40 are connected with each other.

In step S612, upon reception of the printing service Discovery from the PC 50, the image forming apparatus 40 notifies the PC 50 that the apparatus 40 itself is capable of providing a printing service, as a response.

In step S602, upon reception of the notification from the image forming apparatus 40 that the image forming apparatus 40 is capable of providing a printing service, the PC 50 transmits a printable information request to the image forming apparatus 40.

In step S613, in response to the printable information request from the PC 50, the image forming apparatus 40 notifies the PC 50 of information about the printing service that can be provided by the apparatus 40 itself.

In step S603, upon reception of the printable information from the image forming apparatus 40, the PC 50 builds a user interface for generating a print job based on the printable information. More specifically, the PC 50 suitably displays the print image designation, print size, and printable paper size, and provides the user with suitable options via a display (not illustrated) based on the printable information for the image forming apparatus 40. Then, the PC 50 accepts settings from the user via an input device (not illustrated) such as a keyboard.

In step S604, the PC 50 issues a print job based on the settings received from the user and transmits the print job to the image forming apparatus 40.

In step S614, the image forming apparatus 40 receives the print job from the PC 50.

In step S615, the image forming apparatus 40 analyzes the received print job. Image forming for a print job according to the present exemplary embodiment will be described in detail below.

Upon completion of printing, then in step S616, the image forming apparatus 40 notifies the PC 50 of the completion of printing. Then, the image forming apparatus 40 completes processing and enters the standby state.

In step S605, the PC 50 receives the print completion notification and then conveys the information to the user. Then, the PC 50 completes processing.

In the above-described examples of communication, diverse information transmissions are performed in such a way that the PC 50 transmits a request to the image forming apparatus 40 which then issues a response in response to the request. However, the present disclosure is not limited to the above-described communication (what is called pull type communication) but applicable to what is called push type communication in which the image forming apparatus 40 spontaneously transmits data to the PC 50 or a plurality of the PCs 50 existing on a network.

Head Control

Figure 7:
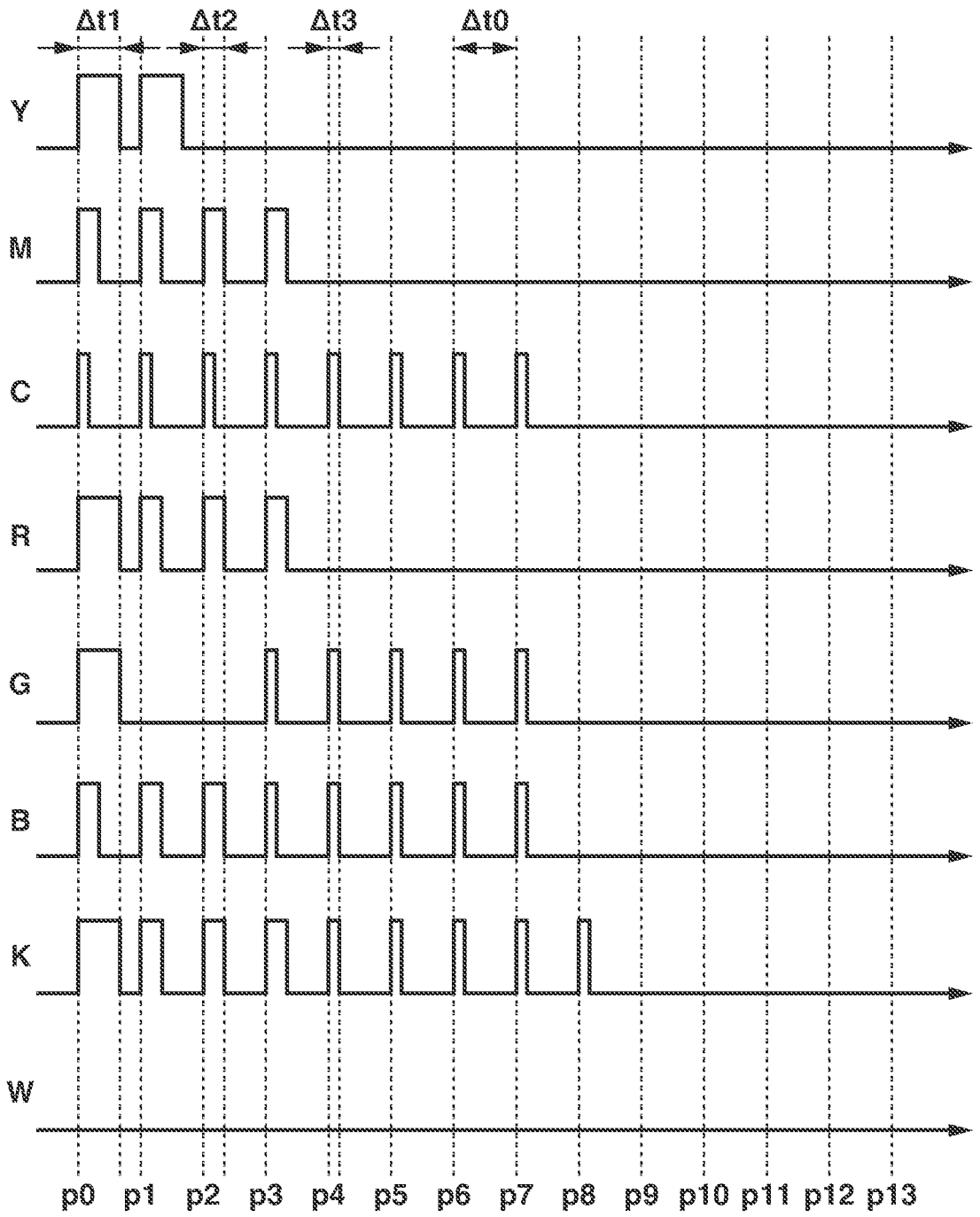
FIG. 7 illustrates heating pulses according to the first exemplary embodiment.

A heating pulse signal used for heating control according to the present disclosure will be described below. FIG. 7 illustrates examples of signal patterns (heating pulses) corresponding to different colors applied to the print head 30. In other words, FIG. 7 illustrates colors to be developed in one pixel on the imaging material 10 and examples of heating pulse configurations at the time of the color development. The colors include yellow (Y), magenta (M), cyan (C), red (R), green (G), blue (B), black (K), and white (W) from the top downward. Referring to FIG. 7, the heating pulse for one pixel includes 14 sections (p0 to p13) each having a length of Δt0. More specifically, the time of the heating pulse required to form one pixel is Δt0*14 sections (p0 to p13). More specifically, a pulse cycle of 14 sections is used for the color development for one pixel, and the color development is controlled by a pulse signal train contained in this pulse cycle. The sections p0 to p8 form heating pulses required for the color development of each layer of the imaging material 10, and p9 to p13 form heating pulses required for preheating the imaging material 10.

Referring to FIG. 7, each signal indicates two values: High (ON) and Low (OFF). When the signal value is High, heating by the resistor 34 is performed. When the signal value is Low, heating is not performed. The color development is controlled by controlling the pulse width and the number of pulses included in the heating pulse for each color. The present exemplary embodiment adjusts the pulse width of each pulse based on Pulse Width Modulation (PWM) control. As illustrated in FIG. 7, descriptions will be made on the premise that the starting point of each section indicates a rise timing (ON timing) of a pulse.

For example, when developing yellow (Y), the CPU 401 performs heating for a duration Δt1 twice in sections p0 and p1 with an interval between pulses to implement the region 21 (a relatively high heating temperature and a relatively short heating time) illustrated in FIG. 2. When developing magenta (M), the CPU 401 performs heating for a duration Δt2 four times with an interval between pulses to implement the region 22 (an intermediate heating temperature and an intermediate heating time) illustrated in FIG. 2. The interval between the first and the second pulses is (Δt0−Δt2). Likewise, when developing cyan (C), the CPU 401 performs heating for a duration Δt3 eight times with an interval between pulses to implement the region 23 (a relatively low heating temperature and a relatively long heating time) illustrated in FIG. 2. The interval between the first and the second pulses is (Δt0−Δt3). Providing this interval prevents the temperature of the imaging material 10 from rising to exceed the target temperature (activation temperature). In other words, the target temperature is maintained by controlling the ON and the OFF time.

To make it easy to understand the chart in FIG. 7, the following relation is satisfied to uniform the total time of the heating pulse application to the print head 30 in developing any color.

$$\Delta t1=\Delta t2*2=\Delta t3*4$$

The following t1 to t3 and Ta1 to Ta3 correspond to the descriptions of FIG. 2.

The heating time necessary for the temperature of the imaging material 10 to exceed the activation temperature illustrated in FIG. 2 is as follows:

$$t2>\text{Heating duration } \Delta t1+\Delta t0 \text{ of } Y>t1$$

$$t3>\text{Heating duration } \Delta t2+\Delta t0*3 \text{ of } M>t2$$

$$\text{Heating duration } \Delta t3+\Delta t0*7 \text{ of } C>t3$$

The heating durations have the following relation:

$$\text{Heating time of } Y<\text{Heating time of } M<\text{Heating time of } C$$

where Y, M, and C denotes the image forming layers 14, 16, and 18, respectively.

The energy (amount of heat) applied to the imaging material 10 by the print head 30 is thermally conducted to the glaze 32 (and the convex glaze 33), the base 31, and the heat sink 35 of the print head 30 illustrated in FIG. 3A in the interval time of each signal. Therefore, the temperature of the imaging material 10 decreases in the interval time. Likewise, the amount of heat thermally conducted into the imaging material 10 propagates heat to the periphery of the platen 43 illustrated in FIG. 4, thus lowering the temperature of the imaging material 10. As a result, the peak temperature due to heating satisfies the following condition with the same input energy (amount of heat):

$$Y>M>C$$

Each of colors Y, M, and C can be independently developed by controlling the peak temperature so that the following conditions are satisfied:

$$\text{Peak temperature of } Y>Ta3$$

$$Ta3>\text{Peak temperature of } M>Ta2$$

$$Ta2>\text{Peak temperature of } C>Ta1$$

The heating pulses for controlling the color development of the secondary colors, red (R), green (G), and blue (B) will be described below. The N-th order color means a color represented by combining developed N coloring materials (image forming layers). Red (R) is reproduced by controlling the heating pulses to develop yellow (Y) and magenta (M) in this order. More specifically, a red (R) image is formed by developing the colors of the image forming layer 14 corresponding to yellow (Y) and the image forming layer 16 corresponding to magenta (M). Green (G) illustrated in FIG. 7 is reproduced by controlling the heating pulses to develop yellow (Y) and cyan (C) in this order. Likewise, blue (B) illustrated in FIG. 7 is reproduced by controlling the heating pulses to develop magenta (M) and cyan (C) in this order. Black (K) illustrated in FIG. 7 is reproduced by controlling the heating pulses to develop yellow (Y), magenta (M), and cyan (C) in this order. For white (W) illustrated in FIG. 7, the color development of paper is not required and therefore no heating pulse is input.

Figure 8:
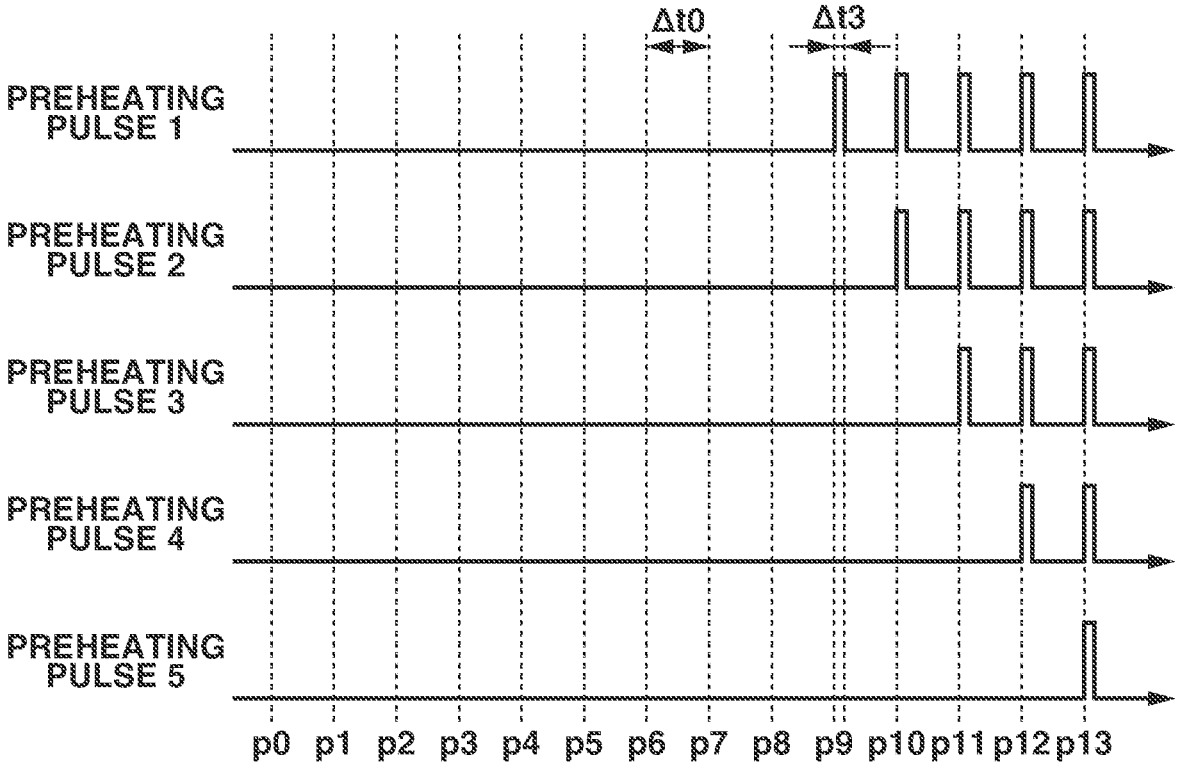
FIG. 8 illustrates preheating pulses according to the first exemplary embodiment.

Subsequently, signals used for preheating control will be described below with reference to FIG. 8. Δt0 and Δt3 in FIG. 8 are similar to Δt0 and Δt3 in FIG. 7, respectively. A preheating pulse 1 implements a heating pulse with a pulse duration Δt3 five times in sections p9, p10, p11, p12, and p13 with an interval between pulses to preheat the imaging material 10 so that its temperature does not exceed the activation temperature (Ta1). Likewise, a preheating pulse 2 implements a heating pulse with a pulse duration Δt3 four times in sections p10, p11, p12, and p13 with an interval between pulses. A preheating pulse 3 implements a heating pulse with a pulse duration Δt3 three times in sections p11, p12, and p13 with an interval between pulses. A preheating pulse 4 implements a heating pulse with a pulse duration Δt3 twice in sections p12 and p13 with an interval between pulses. A preheating pulse 5 implements a heating pulse with a pulse duration Δt3 once in the section p13 with an interval. The preheating pulses 1, 2, 3, 4, and 5 apply higher preheating temperatures to the imaging material 10 in this order. Preheating is performed when the above-described preheating pulses are applied in sections p9 to p13 after the pulse application for the color development in sections p0 to p8 illustrated in FIG. 7. Although FIG. 7 illustrates five different preheating pulses having different counts of heating with a pulse duration Δt3, the pulse length may be changed or both the heating count and the pulse length may be changed so that the color development is performed.

Figure 9A:
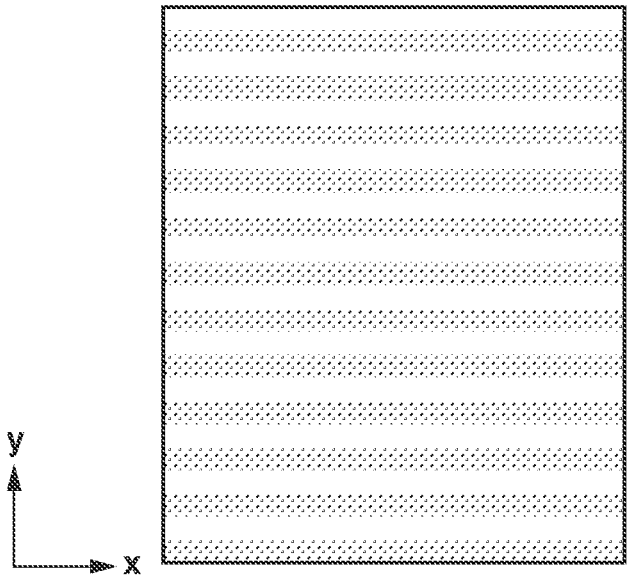
FIGS. 9A and 9B illustrate examples of images according to the first exemplary embodiment.
Figure 9B:
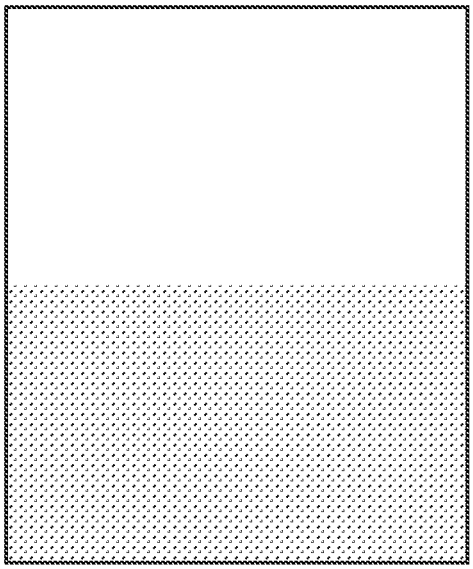

FIG. 9A illustrates an example of a high-frequency image, and FIG. 9B illustrates an example of a low-frequency image. In a case where a low-frequency image is to be recorded, pixels subjected to the color development are often contiguous. Accordingly, the heat of a pulse applied to a pixel is propagated to the subsequent pixel, resulting in a state where the subsequent pixel has already been heated and likely to develop the color without being applied with a number of preheating pulses. On the other hand, in a case where a high-frequency image is to be recorded, pixels subjected to the color development are often noncontiguous. Accordingly, since there are many pixels preceding pixels of which are not subjected to the color development, many pixels are not heated by pulse application to the preceding pixels.

For this reason, the way of the color development depends on the frequency of the image even if the same pulse is applied for the color development.

According to the present exemplary embodiment, therefore, preheating pulses to be applied are changed according to the frequency of an image. More specifically, the preheating temperature applied to the imaging material 10 for a high-frequency image is made higher than the preheating temperature applied thereto for a low frequency image.

Processing Flow

Figure 10:
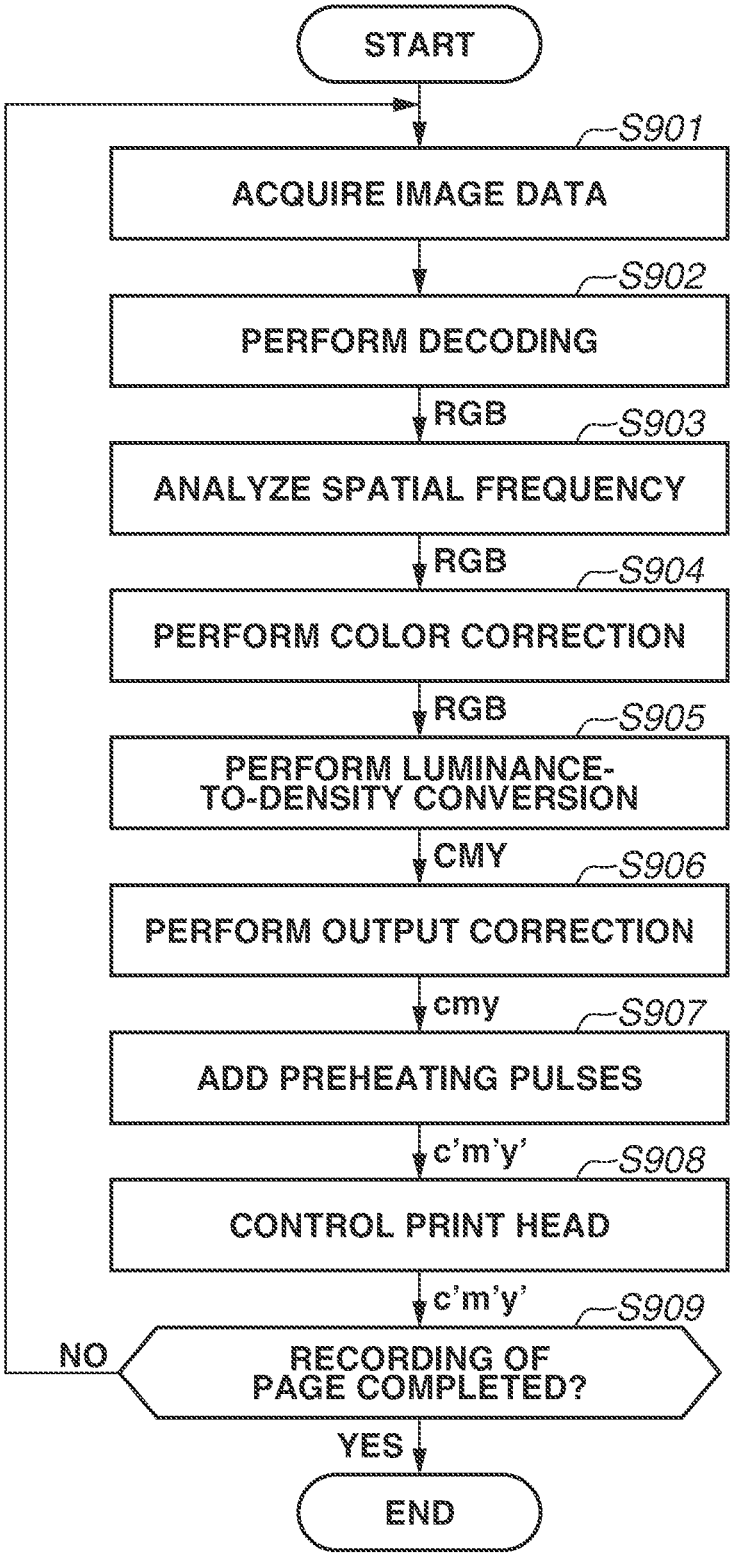
FIG. 10 is a flowchart illustrating image forming processing according to the first exemplary embodiment.

FIG. 10 is a flowchart illustrating image processing for implementing heating pulses according to the present exemplary embodiment. The flowchart illustrated in FIG. 10 is performed in step S615 in FIG. 6. This flowchart is implemented when the CPU 401 of the image forming apparatus 40 reads a program and data stored in the ROM 403 and then executes the program. This processing may be partly performed by the image processing accelerator 407.

In step S901, the CPU 401 acquires image data in the print job received in step S614 in FIG. 6. The following descriptions will be made on the premise that image data is acquired on a page basis.

In step S902, the CPU 401 subjects the image data to decoding processing. This processing may be omitted when the image data is neither compressed nor encoded. The decoding processing converts the image data into red, green, and blue (RGB) data. Examples of RGB data types include sRGB, Adobe® RGB, and other standard color information. Although, in the present exemplary embodiment, image data includes 8-bit information for each color having a value from 0 to 255, image data may be composed of 16 bits or other number of bits.

In step S903, the CPU 401 analyzes the spatial frequency of the image for one page to be recorded for the entire imaging material 10. Examples of usable methods for calculating the spatial frequency include Fast Fourier Transform (FFT) and Discrete Fourier Transform (DFT). Using these calculation methods calculates the spatial frequency as one value. The calculated spatial frequency is determined based on a threshold value to be classified as a high frequency or a low frequency. The result of the calculated classification is stored in the RAM 402. According to the present exemplary embodiment, a half of the maximum value is set as the threshold value. If the spatial frequency is smaller than the threshold value, an image is classified as a low-frequency image. If the spatial frequency is equal to or larger than the threshold value, the image is classified as a high-frequency image. Some images include both a high-frequency portion and a low-frequency portion. For an example of an image having high-frequency components as most components, the result of calculation indicates that the image is a high-frequency image.

In step S904, the CPU 401 subjects the image data to color correction processing. The color correction processing may be performed by the PC 50. Alternatively, the color correction processing conforming to the image forming apparatus 40 may be performed by the image forming apparatus 40. Image data that has been subjected to the color correction processing is RGB data. At this timing, the RGB data is specialized to the image forming apparatus 40, i.e., what is called the "device RGB" format.

In step S905, the CPU 401 subjects the image data to luminance-to-density conversion by using a three-dimensional lookup table. For example, a general thermal printer performs the following conversion by using the RGB signals of the image data:

$$C=255-R$$

$$M=255-G$$

$$Y=255-B$$

On the other hand, in the case of pulse control according to the present exemplary embodiment, for example, the control parameters of magenta that forms monochromatic magenta (M) are different from the control parameters of magenta that preferably forms red (R). It is desirable to perform the luminance-to-density conversion using a three-dimensional lookup table to separately set the control parameters for both colors. Although any method may be used to perform the conversion, a method for using a three-dimensional lookup table will be described below as a more preferable method.

In the present exemplary embodiment, the luminance-to-density conversion is performed by using a three-dimensional lookup table as follows. For the following function 3D_LUT[R][G][B][N] of the three-dimensional lookup table, RGB data values are input to each of the variables R, G, and B, and either one of outputs C, M, and Y is specified as a variable N. In this case, 0, 1, and 2 are specified as C, M, and Y, respectively, as follows:

$$C=3D_LUT[R][G][B][0]$$

$$M=3D_LUT[R][G][B][1]$$

$$Y=3D_LUT[R][G][B][2]$$

The above-described 3D_LUT includes 256*256*256*3=50,331,648 data items. Each data item corresponds to the pulse width to be applied in sections p0 to p8 in FIG. 7. To reduce the amount of data of the lookup table, for example, the number of grids may be reduced from 256 to 17, and a result may be calculated through the interpolation calculation by using 17*17*17*3=14,739 data items. Of course, the number of grids is not limited to 17. Any desired number of grids, for example, 16, 9, and 8 grids may be suitably set. An arbitrary interpolation method, such as a known tetrahedral interpolation method, is also applicable. According to the present exemplary embodiment, the three-dimensional lookup table is predefined and stored in the ROM 403 of the image forming apparatus 40.

Using the three-dimensional lookup table enables separately setting the control parameters for yellow (Y), magenta (M), and cyan (C) that form each color. More specifically, this table enables independently setting the control parameters for yellow and magenta that form red (R), the control parameters for cyan and yellow that form green (G), the control parameters for magenta and cyan that form blue (B), and the control parameters for yellow, magenta, and cyan that form black (K). This makes it possible to more finely control the color development, thus contributing to the improvement of the color reproducibility.

In step S906, the CPU 401 subjects the converted image data to output correction. First, the CPU 401 calculates the pulse widths for implementing the densities of C, M, and Y by using a conversion table corresponding to each color. c, m, and y indicate the pulse widths corresponding to the values of C, M, and Y, respectively. The conversion table (conversion formula) is predefined and stored in the ROM 403 of the image forming apparatus 40.

c=1D_LUT[C]
m=1D_LUT[M]
y=1D_LUT[Y]

The maximal value of the pulse width indicated by c is Δt3 in FIG. 7. The maximal value of the pulse width indicated by m is Δt2 in FIG. 7. The maximal value of the pulse width indicated by y is Δt1 in FIG. 7. The image forming apparatus 40 is capable of modulating the color development intensity in the imaging material 10 through the pulse width modulation. Therefore, when the above-described c, m, and y are smaller than the maximum values, a desired gradation can be implemented by shortening the pulse widths. This processing may be performed by using a known method.

The CPU 401 modulates the heating pulses according to the temperature of the imaging material 10 (or the print head 30) acquired by the temperature sensor 45. More specifically, the CPU 401 performs control to shorten the pulse width of the heating pulse used to reach the activation temperature as the temperature detected by the temperature sensor 45 rises. This processing may be performed by using a known method. The CPU 401 acquires the temperature of the imaging material 10 via the temperature sensor 45 as described above. However, the PC 50 and the image forming apparatus 40 may estimate the temperature of the imaging material 10 and the print head 30, and perform control based on the estimated temperature. A method of temperature estimation is not limited to a specific method, and a known method is also applicable.

In step S907, the CPU 401 adds the preheating pulses illustrated in FIG. 8 according to the spatial frequency of the image to be recorded, based on the entire image data of one page in the cmy data generated in step S906. In step S903, if the result of the spatial frequency analysis stored in the RAM 402 indicates that the frequency of the entire image data is a high frequency, the CPU 401 adds preheating pulse 1 to raise the preheating temperature of the imaging material 10. On the other hand, if the result of the spatial frequency analysis indicates that the frequency of the entire image data is a low frequency, the CPU 401 adds the preheating pulse 3 to relatively lower the preheating temperature of the imaging material 10 in comparison with that in a case where the result indicates a high frequency. Although the present exemplary embodiment has been described above centering on a method for classifying the spatial frequency into two different spatial frequencies, the number of categories of the spatial frequency may be increased. In this case, the number of applicable types of preheating pulses need to be increased.

In step S908, the CPU 401 controls the print head 30 via the head controller 405 according to the pulses generated in step S907. The CPU 401 controls the heating pulse of Y, the heating pulse of M, and the heating pulse of C illustrated in FIG. 7 to heat the imaging material 10 by using the print head 30, thus forming desired colors on the imaging material 10.

In step S909, the CPU 401 determines whether recording of the page is completed.

If recording of the page is completed (YES in step S909), the processing exits this flowchart. Then, the CPU 401 proceeds with the processing of the next page, or the processing proceeds to step S616 in FIG. 6. On the other hand, if recording of the page is not completed (NO in step S909), the processing returns to step S901. Then, the CPU 401 continues the image forming processing on the page.

Referring to the examples in FIGS. 7 and 8 as described above, the preheating pulses can be controlled according to the spatial frequency of the image to be recorded, based on the image data. As a result, unnecessary preheating pulses can be reduced to prolong the life of the battery.

The first exemplary embodiment has been described below centering on an example where the spatial frequency of the entire image data is analyzed to determine preheating pulses. A second exemplary embodiment will be described below centering on an example where the image data is divided into regions and preheating pulses are determined for each region, and an example where preheating pulses are determined in the main color developing layer, with reference to FIG. 12. Portions different from the first exemplary embodiment will be mainly described below.

Figure 12:
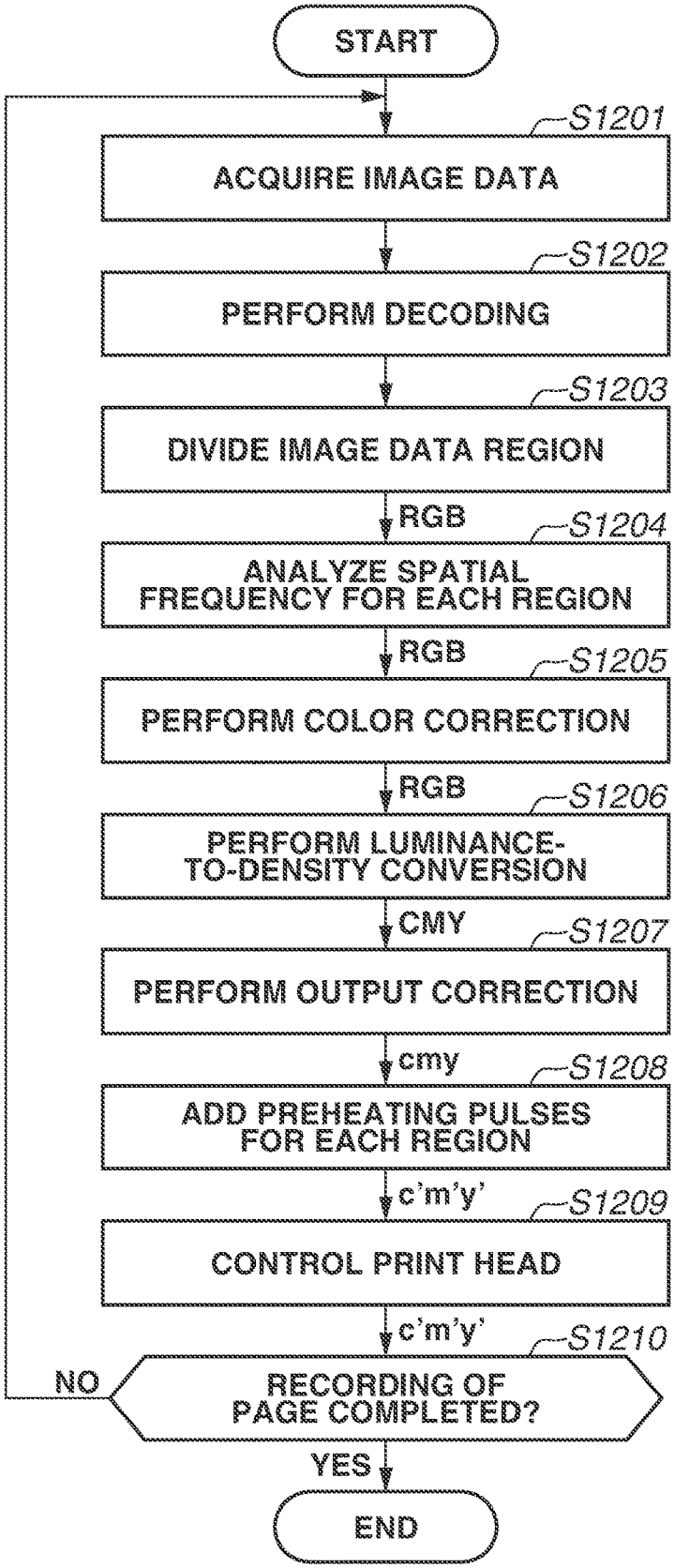
FIG. 12 is a flowchart illustrating image forming processing according to the second exemplary embodiment.

The flowchart in FIG. 12 is implemented when the CPU 401 of the image forming apparatus 40 reads a program and data stored in the ROM 403 and then executes the program.

Steps S1201 to S1202, steps S1205 to S1207, and steps S1209 to S1210 in FIG. 12 perform similar processing to steps S901 to S902, steps S904 to S906, and steps S908 to S910 in FIG. 6, respectively, according to the first exemplary embodiment. Therefore, according to the present exemplary embodiment, descriptions of these steps will be omitted.

In step S1203, as a difference from the first exemplary embodiment, the CPU 401 divides the image data into regions and calculates the spatial frequency for each divided region. In step S1203, the CPU 401 divides the image data into regions each having a predetermined size.

Figure 11:
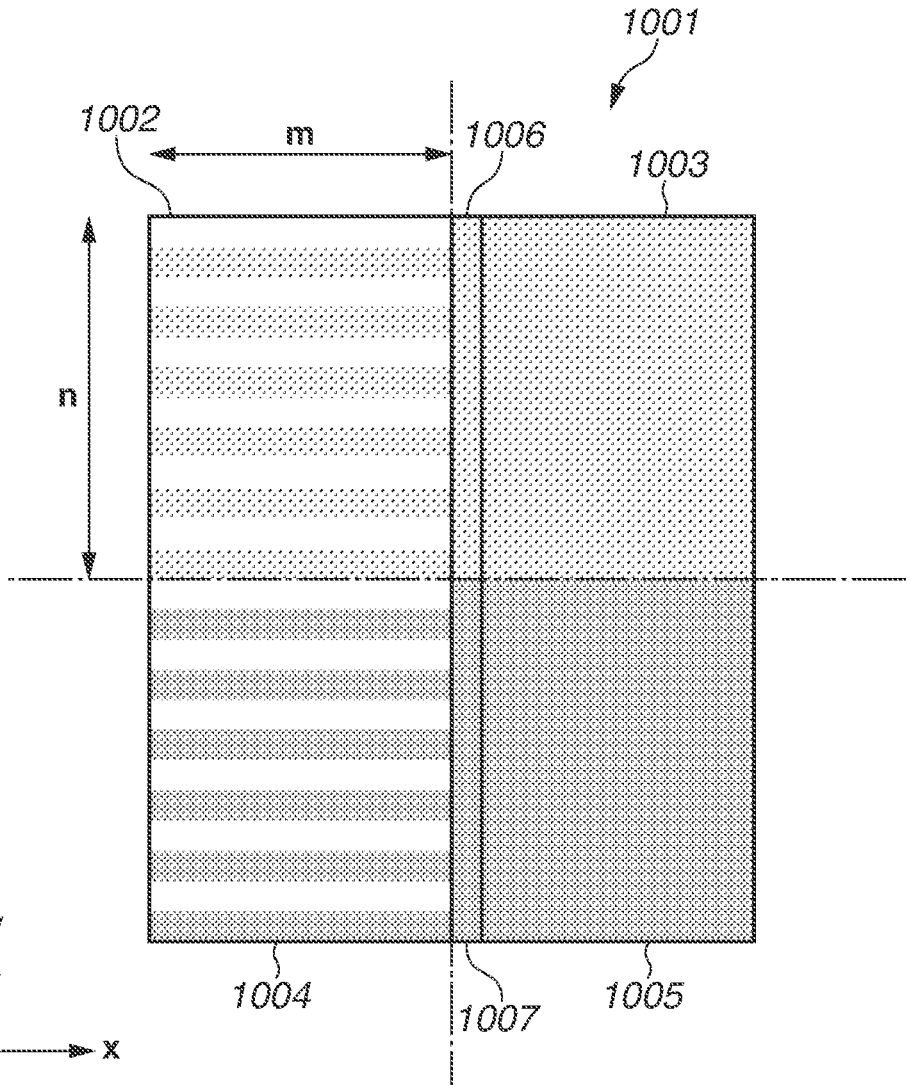
FIG. 11 illustrates a region division on image data according to a second exemplary embodiment.

In step S1204, the CPU 401 calculates the spatial frequency for each divided region. Referring to FIG. 11, image data 1001 is divided by two in the vertical and horizontal directions to form a 2-by-2 regions (divided regions 1002 to 1005) each including m pixels in the x direction and n pixels in the y direction. The divided region 1002 as the upper left region includes a cyan (C) line with (R, G, B)=(0, 255, 255) and a white (W) line with (R, G, B)=(255, 255, 255) repetitively arranged in alternation. The divided region 1003 as the upper right region is uniformly filled with cyan (C). The divided region 1004 as the lower left region includes a yellow (Y) line with (R, G, B)=(255, 255, 0) and a white (W) line repetitively arranged in alternation. The divided region 1005 as the lower right region is uniformly filled with yellow (Y). The CPU 401 analyzes the spatial frequency by using a similar method to the method according to the first exemplary embodiment. Then, the CPU 401 classifies the divided regions 1002 and 1004 as high-frequency regions and the divided regions 1003 and 1005 as low-frequency regions, and stores the calculated result of the classification in the RAM 402.

In step S1208, unlike the first exemplary embodiment, the CPU 401 sets preheating pulses according to the spatial frequency for each divided region, and identifies the main color developing layer for each divided region based on operation pulses for the cmy data generated in step S1207. More specifically, the CPU 401 references the cmy data of each pixel to calculate the number of pixels (Sum14) subjected to the color development of the image forming layer 14 (Y), the number of pixels (Sum16) subjected to the color development of the image forming layer 16 (M), and the number of pixels (Sum18) subjected to the color development of the image forming layer 18 (C). The maximal value of Sum14, Sum16, and Sum18 is recognized as the main color developing layer. As an example, since the divided region 1003 includes a cyan (C) uniform image as the image to be recorded, Sum14=0, Sum16=0, and Sum18=m*n. Since the maximum value is Sum18, the main color developing layer is the image forming layer 18. As a result of the calculation, the divided regions 1002 to 1005 are classified as follows:

- The divided region 1002 is a high-frequency region where the main color developing layer is the image forming layer 18.
- The divided region 1003 is a low-frequency region where the main color developing layer is the image forming layer 18.
- The divided region 1004 is a high-frequency region where the main color developing layer is the image forming layer 14.
- The divided region 1005 is a low-frequency region where the main color developing layer is the image forming layer 14.

FIG. 13 illustrates an example of a table illustrating preheating pulses to be added for each of the spatial frequencies and the main color developing layers. Since the divided region 1002 is a high-frequency region where the main color developing layer is the image forming layer 18, the CPU 401 adds the preheating pulse 1 to the cmy data generated in step S1207. Likewise, since the divided region 1003 is a low-frequency region where the main color developing layer is the image forming layer 18, the CPU 401 adds the preheating pulse 3 to the cmy data generated in step S1207. Since the divided region 1004 is a high-frequency region where the main color developing layer is the image forming layer 14, the CPU 401 adds the preheating pulse 2 to the cmy data generated in step S1207. Since the divided region 1005 is a low-frequency region where the main color developing layer is the image forming layer 14, the CPU 401 adds the preheating pulse 4 to the cmy data generated in step S1207. Further, a region 1006 included in the divided region 1003 is adjacent to the divided region 1002 determined to be a high-frequency region. Likewise, a region 1007 included in the divided region 1005 is adjacent to the divided region 1004 determined to be a high-frequency region. Since the preheating temperature for a high-frequency region is made higher than that for a low-frequency region, the preheat applied to the divided region 1002 propagates to the region 1006, possibly causing the false color development of the region 1006. Likewise, the preheat applied to the divided region 1004 propagates to the region 1007, possibly causing the false color development of the region 1007. Therefore, the CPU 401 further lowers the preheating temperature for a low-frequency region in the vicinity of a high-frequency region including a portion adjacent to the high-frequency region. Since the region 1006 is a low-frequency region where the main color developing layer is the image forming layer 18, and is adjacent to a high-frequency region, the CPU 401 adds the preheating pulse 4 to the cmy data generated in step S1207. Since the region 1007 is a low-frequency region where the main color developing layer is the image forming layer 14, and is adjacent to a high-frequency region, the CPU 401 adds the preheating pulse 5 to the cmy data generated in step S1207. The present exemplary embodiment has been described above centering on an example where the preheating pulse of a low-frequency region adjacent to a high-frequency region is changed. However, the preheating pulse of the adjacent low-frequency region may be changed in a case where the difference between the spatial frequencies of the two regions is equal to or larger than a predetermined value.

As described above, preheating pulses can be controlled according to the spatial frequency and the main color developing layer for each divided region of the image data. As a result, unnecessary preheating pulses can be reduced to prolong the life of the battery.

In the above-described exemplary embodiment, the most suitable pulses were generated by adding the preheating pulses illustrated in FIG. 8 to the heating pulses illustrated in FIG. 7. A third exemplary embodiment will be described below centering on an example where pixel values are changed for preheating without adding preheating pulses, with reference to FIGS. 14 and 15. Portions different from the above-described exemplary embodiments will be mainly described below.

Figure 14:
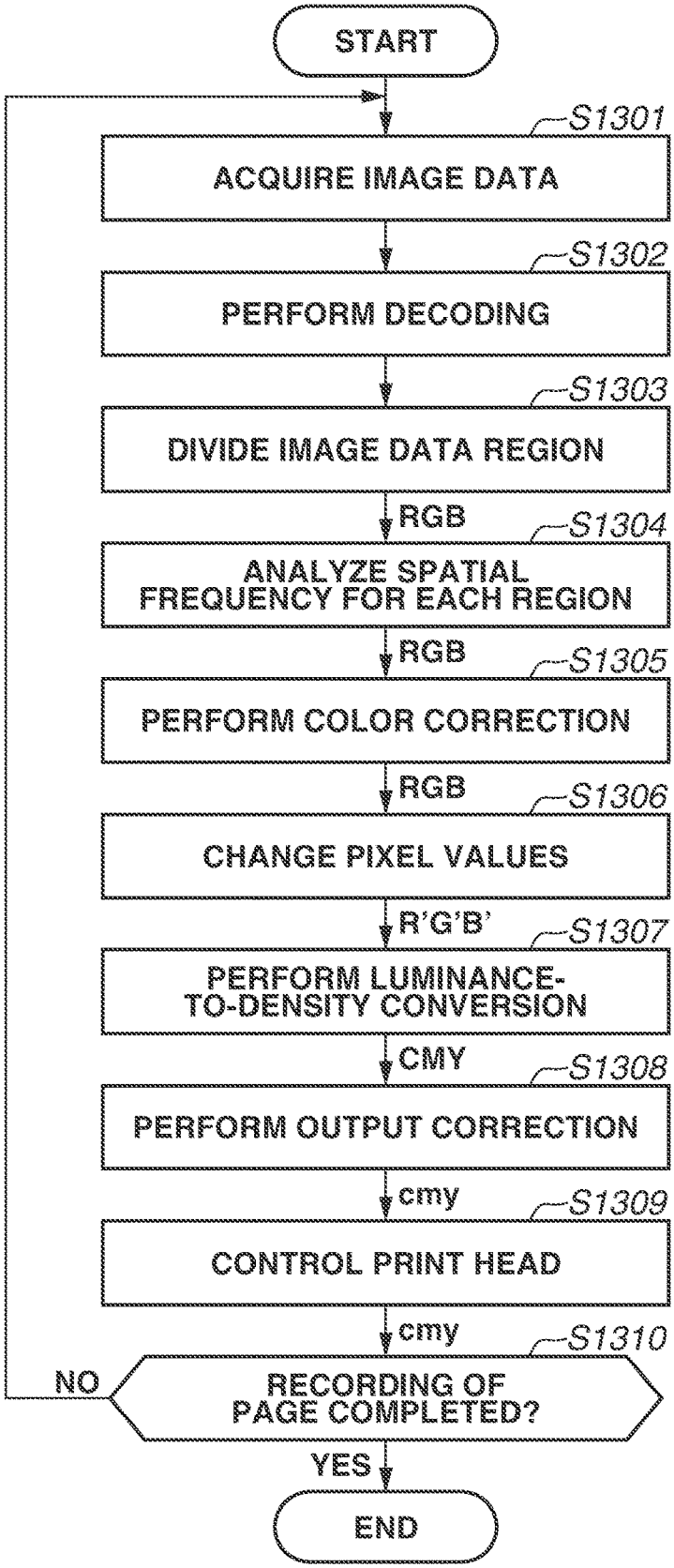
FIG. 14 is a flowchart illustrating image forming processing according to a third exemplary embodiment.

Steps S1301 to S1305, steps S1306 to S1307, and steps S1309 to S1310 in FIG. 14 perform similar processing to steps S1201 to S1205, steps S1206 to S1207, and steps S1209 to S1210 in FIG. 12, respectively, according to the second exemplary embodiment. Therefore, according to the present exemplary embodiment, descriptions of these steps will be omitted.

Figure 15:
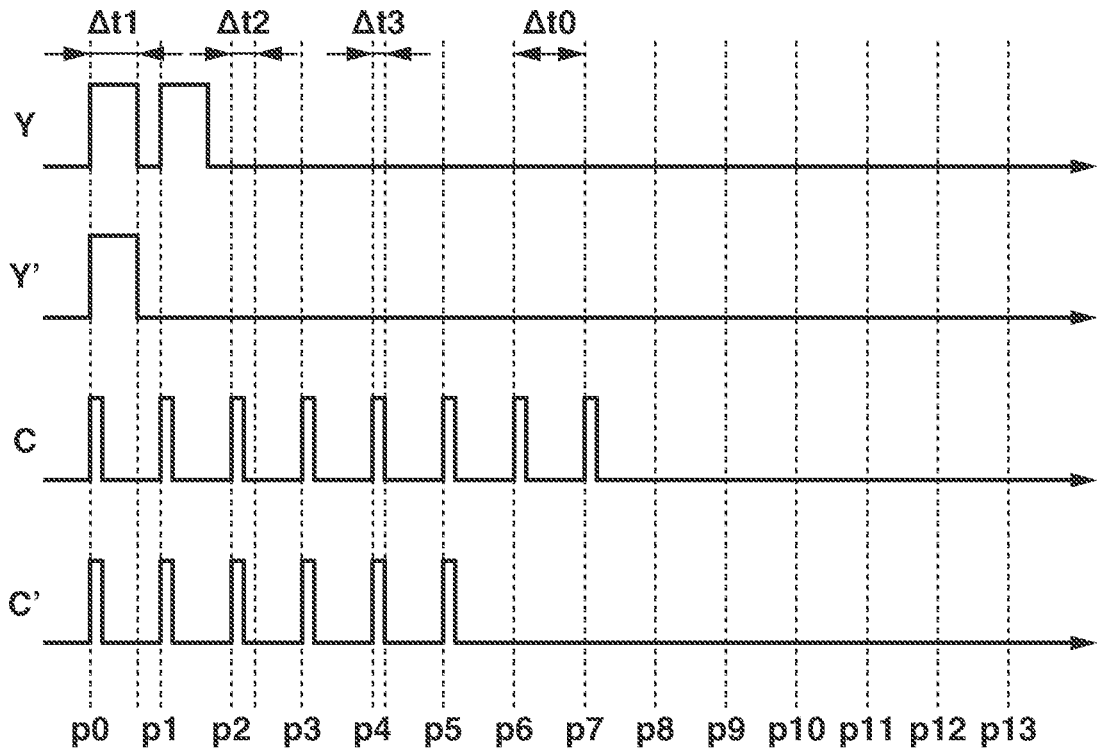
FIG. 15 illustrates examples of heating pulse configurations according to the third exemplary embodiment.

In step S1306, unlike the second exemplary embodiment, the CPU 401 changes the pixel values for preheating instead of adding preheating pulses. FIG. 15 illustrates examples of heating pulses according to the present exemplary embodiment. Referring to FIG. 15, Y denotes a heating pulse of yellow (Y) (R, G, B)=(255, 255, 0), and Y' denotes another heating pulse of yellow (Y) ((R, G, B)=(255, 255, 10). Likewise, C denotes a heating pulse of cyan (C) ((R, G, B)=(0, 255, 255), and C' denotes another heating pulse of cyan (C) ((R, G, B)=(10, 255, 255). Y' denotes a pulse that slightly develops the color of the image forming layer 14. Likewise, C' denotes a pulse that slightly develops the color of the image forming layer 18.

For the divided region 1002 (FIG. 11) as a high-frequency region where the main color developing layer is the image forming layer 18, the CPU 401 replaces the cmy data of white (W) ((R, G, B)=(255, 255, 255) with the heating pulse C'. This processing causes a high preheating temperature of the divided region 1002 in comparison with that in a case where data is recorded at the position corresponding to the white pixel in the original image data, based on the cmy data of white (W) ((R, G, B)=(255, 255, 255). Likewise, for the divided region 1004 as a high-frequency region where the main color developing layer is the image forming layer 14, the CPU 401 replaces the cmy data of white (W) ((R, G, B)=(255, 255, 255) with the heating pulse Y' to raise the preheating temperature of the divided region 1004. Also, for pixels other than white pixels, the CPU 401 may replace the pixel values to raise the heating temperature before heating the imaging material 10. For low-frequency images such as the divided regions 1003 and 1005, the CPU 401 does not replace the cmy data of each pixel because changing the pixel values causes little effect of raising the preheating temperature. The pixel signal value to be replaced is to be considered as illustrative, and the pixel values to be replaced may be determined by a trade-off between the preheating temperature and the false color development.

As described above, replacing image values enables controlling the preheating temperature of each region.

The above-described exemplary embodiments make it possible to restrict the power consumption in image recording.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2021-124185, filed Jul. 29, 2021, which is hereby incorporated by reference herein in its entirety.

What is claimed is:

1. An image forming apparatus comprising:

a print head including heating elements for applying a thermal energy to an imaging material having a plurality of color developing layers that are laminated from a side of the print head, the plurality of color developing layers corresponding to a plurality of colors and configured to develop colors when heated, and the print head configured to develop the color of a desired color developing layer from among the plurality of color developing layers to form an image on the imaging material;

an operation unit configured to operate the plurality of heating elements of the print head by using a first pulse for preheating the color developing layers and a second pulse for developing the colors of the color developing layers; and a generation unit configured to, in a case where a spatial frequency of the image to be recorded based on image data for forming an image on the imaging material is lower than a predetermined frequency, generate the first pulse so that a temperature to be applied to the imaging material by the first pulse is lower than a temperature to be applied to the imaging material in a case where the spatial frequency of the image data is equal to or higher than the predetermined frequency.

2. The image forming apparatus according to claim 1, wherein the generation unit generates the first pulse so that the number of applications of the first pulse is less in a case where the image to be recorded based on the image data has a low spatial frequency than a case where the image to be recorded based on the image data has a high spatial frequency.

3. The image forming apparatus according to claim 1, further comprising an analysis unit configured to analyze the spatial frequency of the image to be recorded based on the image data of the image to be formed on the imaging material, wherein the generation unit generates the first pulse based on the spatial frequency of the image to be recorded based on the image data analyzed by the analysis unit.

4. The image forming apparatus according to claim 3, wherein the analysis unit analyzes the spatial frequency of the image to be recorded based on the image data of the image to be recorded on the entire imaging material.

5. The image forming apparatus according to claim 4, wherein the generation unit generates the first pulse so that the same first pulse is applied to all pixels of the imaging material based on the spatial frequency of the image to be recorded based on the image data analyzed by the analysis unit.

6. The image forming apparatus according to claim 3, wherein the analysis unit divides the image to be recorded on the imaging material into regions, and analyzes the spatial frequency of the image to be recorded based on the image data for each divided region.

7. The image forming apparatus according to claim 6, wherein the generation unit generates the first pulse so that the same first pulse is applied to the pixels in the divided region based on the spatial frequency of the image to be recorded based on the image data analyzed by the analysis unit.

8. The image forming apparatus according to claim 6, wherein, in a case where the image to be recorded based on the image data of the divided region has a low spatial frequency and an image to be recorded based on the image data of a divided region adjacent to the divided region has a high spatial frequency, the generation unit generates the first pulse so that the temperature to be applied to the imaging material by the first pulse in a region in the vicinity of the divided region having a high spatial frequency is lower than the temperature to be applied to the imaging material in a region not in the vicinity of the divided region having a high spatial frequency from among the divided regions having a low spatial frequency.

9. The image forming apparatus according to claim 6, further comprising an identification unit configured to identify a color developing layer having a largest region subjected to color development in the divided region, wherein the generation unit generates the first pulse based on the color developing layer identified by the identification unit.

10. The image forming apparatus according to claim 9, wherein the imaging material includes a first color developing layer, and a second color developing layer where a color developing temperature is lower than that in the first color developing layer, and wherein, in a case where the color developing layer having the largest region subjected to color development identified by the identification unit is the second color developing layer, the first pulse is generated so that the temperature to be applied to the imaging material by the first pulse is higher than the temperature to be applied to the imaging material in a case where the color developing layer having the largest region subjected to color development is the first color developing layer.

11. The image forming apparatus according to claim 1, wherein the imaging material includes color developing layers corresponding to yellow, magenta, and cyan.

12. The image forming apparatus according to claim 11, wherein the color developing layers are a yellow color developing layer, a magenta color developing layer, and a cyan color developing layer stacked in this order from the side where the thermal energy is applied by the print head.

13. The image forming apparatus according to claim 1, wherein the generation unit outputs a signal pattern for controlling the thermal energy to be applied to the imaging material by the print head, the signal pattern defining a heating temperature and a heating time for the imaging material based on a pulse width and the number of pulses.

14. An image forming apparatus comprising:

a print head including heating elements for applying a thermal energy to an imaging material having a plurality of color developing layers that are stacked on top of another, the plurality of color developing layers corresponding to a plurality of colors and configured to develop colors when heated, and the print head configured to develop the color a desired color developing layer from among the plurality of color developing layers to form an image on the imaging material;

an operation unit configured to operate the plurality of heating elements of the print head by using pulses for preheating the color developing layer; and a generation unit configured to generate pulses to be applied to the heating elements based on image data for forming an image on the imaging material, and configured to, when pixel values at a predetermined position of the image data are the same, in a case where the image to be recorded based on the image data has a high spatial frequency, generate pulses so that a temperature to be applied to the predetermined position is higher than a temperature to be applied to the predetermined position in a case where the image to be recorded based on the image data has a low spatial frequency.

15. The image forming apparatus according to claim 14, wherein, in a case where the image to be recorded based on the image data has a high spatial frequency, the generation unit generates pulses so that the temperature to be applied to a position corresponding to a white pixel of the imaging material is higher than the temperature to be applied to the position corresponding to the white pixel of the imaging material in a case where the image to be recorded based on the image data has a low spatial frequency.

16. The image forming apparatus according to claim 15, wherein, in a case where the image to be recorded based on the image data has a low spatial frequency, the generation unit generates pulses so that no pulse is applied to the position corresponding to the white pixel of the imaging material.

17. The image forming apparatus according to claim 15, wherein the imaging material includes color developing layers corresponding to yellow, magenta, and cyan, and wherein, in a case where the image to be recorded based on the image data has a high spatial frequency, the generation unit generates pulses so that a pulse for slightly developing yellow or a pulse for slightly developing cyan is applied to the position corresponding to the white pixel of the imaging material.

18. The image forming apparatus according to claim 14, further comprising an analysis unit configured to analyze the spatial frequency of the image to be recorded based on the image data of the image to be formed on the imaging material, wherein the generation unit generates pulses based on the spatial frequency of the image to be recorded based on the image data analyzed by the analysis unit.

19. The image forming apparatus according to claim 18, wherein the analysis unit analyzes the spatial frequency of the image to be recorded based on the image data for each predetermined region of the image to be recorded on the imaging material.

20. The image forming apparatus according to claim 14, wherein the generation unit outputs a signal pattern for controlling the thermal energy to be applied to the imaging material by the print head, the signal pattern defining a heating temperature and a heating time for the imaging material based on a pulse width and the number of pulses.

21. An image recording method for heating, by using a print head having heating elements, an imaging material having a plurality of color developing layers that are stacked on top of another, the plurality of color developing layers corresponding to a plurality of colors and configured to develop colors when heated, to develop the color of a desired color developing layer from among the plurality of color developing layers to form an image on the imaging material, the method comprising:

generating a first pulse for preheating the color developing layer by using the heating elements based on image data for forming an image on the imaging material and a second pulse for developing the color of the color developing layer; and operating the plurality of heating elements of the print head by using the generated first and second pulses, wherein, in the generation, in a case where the image to be recorded based on the image data has a low spatial frequency, the first pulse is generated so that a temperature to be applied to the imaging material by the first pulse is lower than a temperature to be applied to the imaging material in a case where the image to be recorded based on the image data has a high spatial frequency.

22. An image recording method for heating, by using a print head having heating elements, an imaging material having a plurality of color developing layers that are stacked on top of another, the plurality of color developing layers corresponding to a plurality of colors and configured to develop colors when heated, to develop the color of a desired color developing layer from among the plurality of color developing layers to form an image on the imaging material, the method comprising:

generating pulses to be applied to the heating elements based on image data for forming an image on the imaging material; and operating the plurality of heating elements of the print head by using the generated pulse, wherein, in the generation, when pixel values at a predetermined position of the image data are the same, in a case where the image to be recorded based on the image data has a high spatial frequency, pulses are generated so that a temperature to be applied to the predetermined position is higher than a temperature to be applied to the predetermined position in a case where the image to be recorded based on the image data has a low spatial frequency.

* * * * *